US005226787A

United States Patent [19]

Freeman

[11] Patent Number: 5,226,787

[45] Date of Patent: Jul. 13, 1993

[54] COOLANT PUMP FOR AN INTERNAL COMBUSTION ENGINE

[75] Inventor: Richard R. Freeman, Ardens Grafton, Great Britain

[73] Assignee: Concentric Pumps Limited, Great Britain

[21] Appl. No.: 751,072

[22] Filed: Aug. 28, 1991

[30] Foreign Application Priority Data

Aug. 29, 1990 [GB] United Kingdom ..... 9018851

[51] Int. Cl.[5] ..... F01D 11/02

[52] U.S. Cl. ..... 415/168.2; 415/170.1; 415/230; 123/41.44; 123/195 C; 123/198 C; 277/56; 417/362; 417/364

[58] Field of Search ..... 415/168.1, 168.2, 170.1, 415/229, 230; 123/41.44, 198 C, 195 C; 277/53, 55, 56; 417/362, 364

[56] References Cited

U.S. PATENT DOCUMENTS

| | | | |
|---|---|---|---|
| 2,936,715 | 5/1960 | Southam et al. | 415/230 |
| 3,001,517 | 9/1961 | Baker et al. | 415/168.2 |
| 3,655,295 | 4/1972 | Mitchell | 415/230 |
| 4,380,416 | 4/1983 | Menager . | |
| 4,768,923 | 9/1988 | Baker | 415/230 |
| 4,824,324 | 4/1989 | Mitsumaru et al. | 417/362 |
| 5,125,795 | 6/1992 | Suzuki et al. | 415/168.2 |

FOREIGN PATENT DOCUMENTS

| | | | |
|---|---|---|---|
| 3931938 | 4/1990 | Fed. Rep. of Germany . | |
| 0773185 | 4/1957 | United Kingdom | 123/41.44 |
| 1150635 | 4/1969 | United Kingdom . | |
| 1461901 | 1/1977 | United Kingdom . | |
| 2017822 | 10/1979 | United Kingdom . | |
| 2033979 | 5/1980 | United Kingdom . | |
| 1589877 | 5/1981 | United Kingdom . | |

*Primary Examiner*—Edward K. Look
*Assistant Examiner*—Christopher Verdier
*Attorney, Agent, or Firm*—Learman & McCulloch

[57] ABSTRACT

A water pump has a bowl like body and a seal across the rim of the body. Coolant leakage through the seal is used to wet the rubbing faces of the seal. Superfluous leakage is collected in the bowl so that it may be evaporated by engine heat.

4 Claims, 1 Drawing Sheet

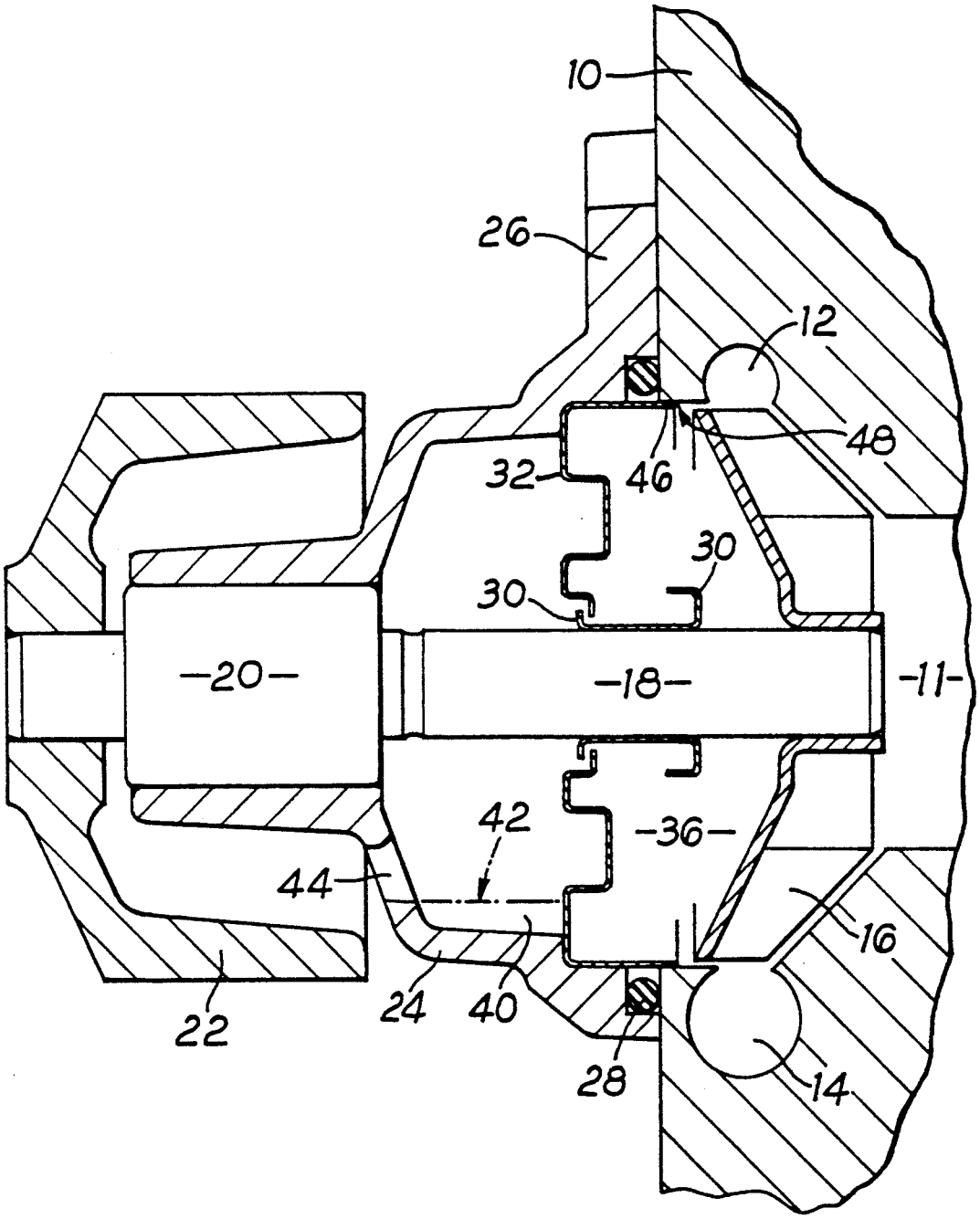
10
26
12
48
46
32
30
30
-20-
-18-
-11-
42
-36-
44
16
22
24
40
28
14

COOLANT PUMP FOR AN INTERNAL COMBUSTION ENGINE

BACKGROUND OF THE INVENTION

This invention relates to coolant pumps for use in internal combustion engines, and of the kind comprising a body adapted to be fixed to an engine block as a cover for a cavity therein, an impeller mounted on a shaft journalled in said body for location in said cavity, bearing means in the body journalling said shaft, drive means for the shaft for example a pulley or gear on the end of the shaft opposite to that provided with the impeller, and a seal between the impeller and the body which may, and often does, according to the design of the seal allow minute bleed or leakage of coolant from the cavity to wet the seal surfaces. It will be appreciated that the cavity forms a pump chamber, and has appropriate passages communicating with the cavity as inlet and outlet for the pump. Thus, the pulley is outside the body, the bearing is between the pulley and impeller, and the seal is between the bearing and the impeller.

The problem with pumps of the mentioned kind is that the minute leakage of coolant is apt to be misinterpreted by mechanics. This leakage is inherent, as is mentioned, in order to wet the seal faces, and excess leakage of coolant evaporates due to engine heat. When the engine is cold, and evaporation does not occur, the leakage may be seen.

SUMMARY OF THE INVENTION

The object of the invention is to retain coolant which seeps through a pump seal until the coolant evaporates and to provide a fixed seal between a shaft seal and an engine block.

According to the invention a pump of the kind mentioned has a bowl-like body, said bearing is located in the base of the bowl, said shaft is coaxial with the bowl, and said seal extends as a cover plate substantially in the plane of the rim of the bowl. The bowl has a drain passage extending (in ordinary usage) above the lowermost point of the bowl. Hence the bowl can collect superfluous leaked coolant when the engine is cool, and retain that as a pool of coolant below the drain passage so that it cannot reach the bearings and additionally the presence of the coolant will not be noted by the mechanic. It is only in the event that the leakage exceeds the possible volume of the pool that flow will occur through the drain passage and hence a genuinely failed pump will be detected. In ordinary usage of a pump which has not failed, the pool will be evaporated by engine heat without ever reaching sufficient volume to overflow through the drain passage.

According to a feature of the invention the seal comprises a sheet metal pressing fixed and sealed in relation to the body for example as an interfernce fit in the rim of the bowl. Preferably the periphery of the pressing is arranged to extend out of the bowl into the engine block cavity: it may then serve as the primary or possibly the only pump location means.

One embodiment of the invention is now more particularly described with reference to the accompanying drawing.

BRIEF DESCRIPTION OF THE DRAWING

FIG. 1 is a view partly in section and partly in elevation of a water pump for an internal combustion engine.

DESCRIPTION OF THE PREFERRED EMBODIMENT

Referring to the drawing, the engine block 10 has a cavity which communicates with inlet port 11 and outlet ports 12, 14 for circulating coolant. The cavity houses vaned impeller 16 mounted on shaft 18 which is journalled in bearing 20 and carries a drive pulley or like 22 at the free outer end of the shaft.

The pump body comprises a bowl 24 having a flange 26 extending radially outwardly at its rim. The flange is adapted to be bolted to the engine block with an interposed O ring 28 trapped in a rebate in the rim.

The body or bowl may be a casting. Conventional water pump bodies have a drilled hole for drainage, or a cored hole provided by adding a hole-forming core to the mould impression, but in this invention the hole 44 (described below) extends generally axially parallel to the axis of shaft 18 and can thus be cored integrally with the impression without needing a separate added core piece.

A seal is diagrammatically indicated by the reference 30,32. This seal is of conventional construction essentially comprising component 30 rotatable with the shaft and part 32 which is stationary with the bowl, and rubbing surfaces located between the parts 30,32.

It will be appreciated by those skilled in the art that the space 36 between the impeller and the seal 30,32 is in effect part of the pump cavity and hence is filled with coolant which may be a water based mixture. Flow to the rubbing surfaces is required but only in minute amounts. Excess fluid collects in the bowl after passing through the seal and may form a pool 40. If the level in the pool were to arise above the chain-dot line 42, which represents a horizontal plane when the pump is in its normal position of use, excess liquid escapes via vent or drain passage 44. The latter is shielded from view by the drive pulley 22 as a further safeguard against coolant escape being misinterpreted.

The outer seal component 32 has an upstanding peripheral flange 46 which could be continuous. Hence, if the cavity and body are circular in a plane normal to the shaft axis, the flange is cylindrical: alternatively the flange could be a series of separate prongs for location. The flange or prongs enter the body cavity at 48 and position the pump relative to the cavity.

It will also be appreciated that the periphery of the seal adjacent the flange or prongs 46 needs to seal with the body 24 to prevent fluid flow at that interface. This may be achieved by a press fit of the parts and/or the use of a sealant, but alternatively O ring 28 may have a dual function of sealing the interface of the pressing 32 and the body 24 as well as preventing leakage out of the pump between the body and the block 10.

I claim:

1. A coolant pump for an internal combustion engine block having a face and a cavity in said block opening to said face, said pump comprising a pump body including a bowl having a bottom and a rim secured to said block, said rim mating with said face so that said bowl closes and completes the cavity; a bearing mounted in the pump body; a shaft journaled in said bearing, said shaft extending through said bowl and into said cavity; an impeller secured to said shaft and accommodated in said cavity; a shaft seal having a first annular component secured to said shaft between the impeller and said bearing and a second annular component having a central aperature that encircles the shaft, said second annular component of the shaft seal having an outside diameter larger than that of the impeller, said second annular component having an outer flange located in a bore in the pump body and extending from said bore into the cavity in said block, said first annular component having a sealing surface in engagement with a sealing surface on the second annular component; a coolant collection zone in the lower part of said bowl between the shaft seal and said bearing for the accommodation of fluid that passes between said first and second annular components; a port in the pump body at a level below that of said bearing and above said coolant collection zone for the passage of coolant from the pump body; and a fixed seal between said block, said rim, and said second annular component.

2. A coolant pump according to claim 1 wherein the outer flange of the second annular component of the shaft seal is press-fit in a bore formed by the rim of the pump body.

3. A coolant pump according to claim 2 wherein a portion of the outer flange of the second annular component of the shaft seal cooperates with the cavity in the engine block to position the pump body relative to the engine block.

4. A coolant pump according to claim 1 wherein the outer flange of the second annular component of the shaft seal forms a wall of the coolant collection zone.

* * * * *